US005715884A

United States Patent [19]

Cotten

[11] Patent Number: 5,715,884

[45] Date of Patent: Feb. 10, 1998

[54] WINDOW COVERING CORD SAFETY ASSEMBLY

[76] Inventor: Fred Cotten, P.O. Box 345, Chicago Park, Calif. 95712

[21] Appl. No.: 781,989

[22] Filed: Jan. 6, 1997

[51] Int. Cl.[6] ..... E06B 9/38

[52] U.S. Cl. ..... 160/178.1 R; 24/115 F

[58] Field of Search ..... 160/178.1 R, 168.1 R, 160/173 R, 320, 178.2 R; 16/114 B, 121, 122; 24/115 F

[56] References Cited

U.S. PATENT DOCUMENTS

| | | | |
|---|---|---|---|
| 3,633,646 | 1/1972 | Zilver | 160/168.1 R |
| 4,909,298 | 3/1990 | Langhart . | |
| 5,472,036 | 12/1995 | Judkins | 160/178.2 R |
| 5,473,797 | 12/1995 | Wu . | |
| 5,494,092 | 2/1996 | Georgopoulos . | |
| 5,501,262 | 3/1996 | Inaba et al. | 160/178.2 R |
| 5,504,977 | 4/1996 | Weppner . | |
| 5,560,414 | 10/1996 | Judkins et al. | 160/178.1 R |

*Primary Examiner*—David M. Purol
*Attorney, Agent, or Firm*—Donald E. Nist

[57] ABSTRACT

The window covering cord safety assembly includes at least one window covering control cord, and preferably two or more such cords, the free ends of which bear expanded beads or eyelets or the like. A safety device is releasably connected to the free ends of the control cords. The device includes a housing having closed upper and lower ends interconnected by closed sidewalls and collectively defining a generally central space within which a retainer is slideably disposed. The retainer has external pockets in its lower portion. The space has an expanded upper portion and the retainer has a lower portion of reduced diameter. The free ends of the control cords and eyelets pass down through openings in the housing top into the retainer pockets and are trapped therein until the lower portion of the retainer moves up into the expanded upper portion of the space to release them from the retainer pockets. A spring is mounted between the retainer top and the housing top to bias the retainer downwardly. A screw can pass down through the housing top to adjustably compress the spring and therey control the upward force necessary to move the retainer into the control cord-releasing position. An operating cord can be secured to the bottom of the retainer and depend from the housing. Separation of the control cords from the housing and each other prevents constricting entangling of a child in the control cords.

8 Claims, 2 Drawing Sheets

FIG. 1
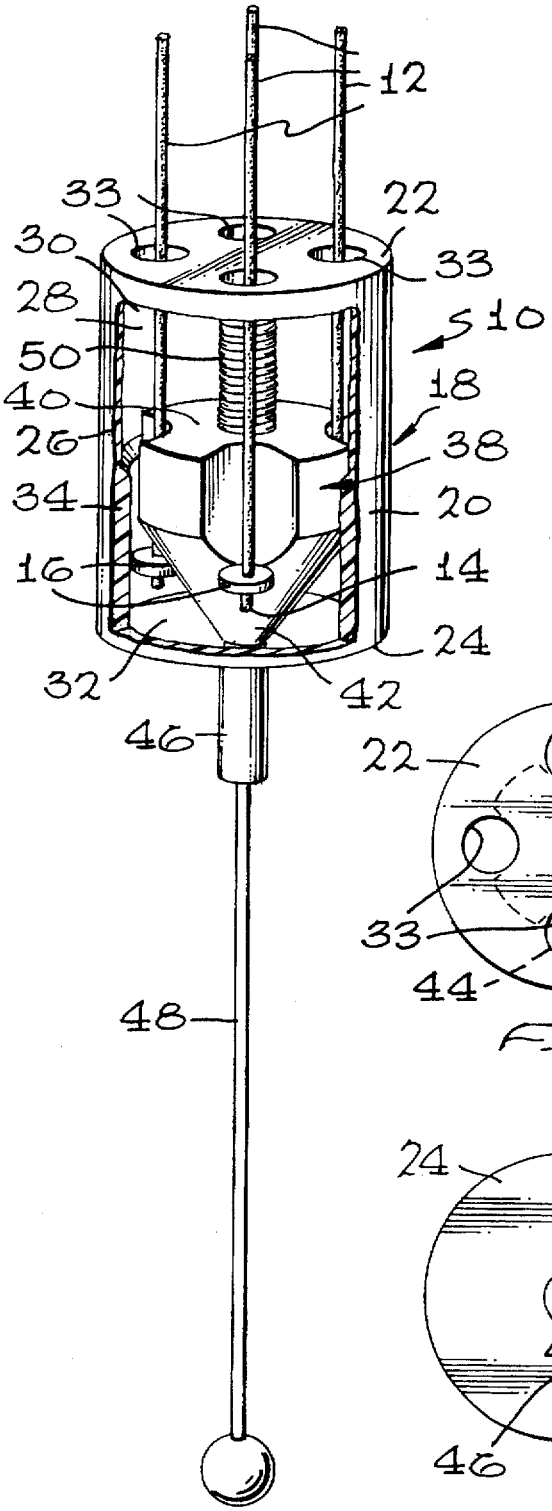
FIG. 2
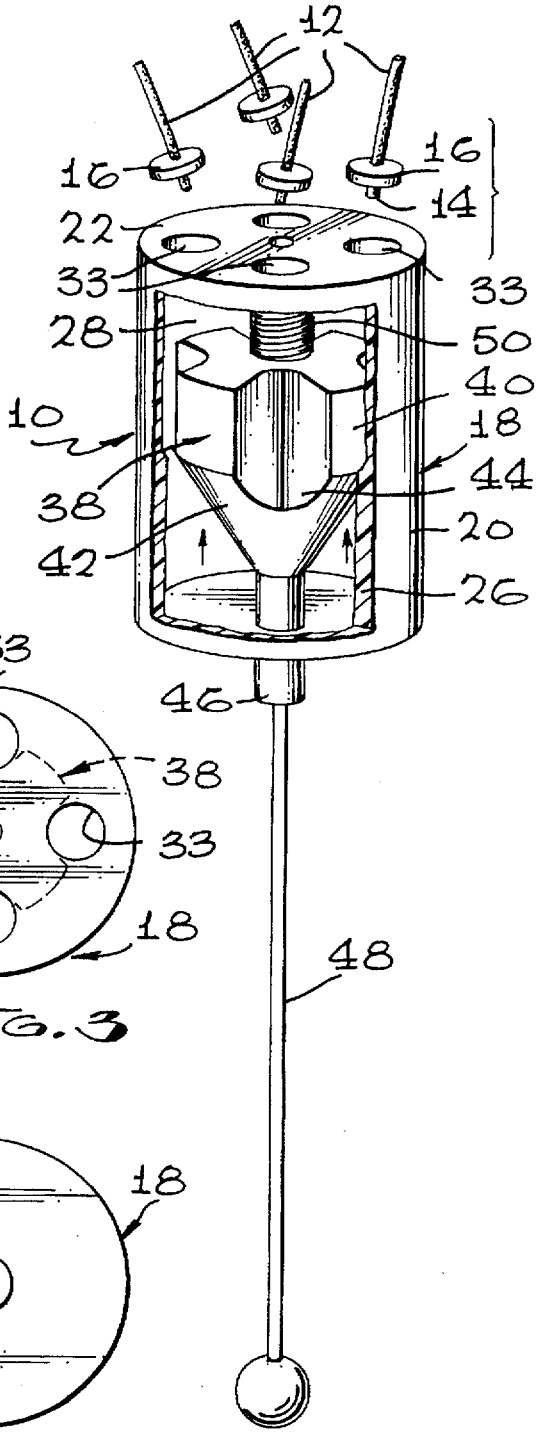
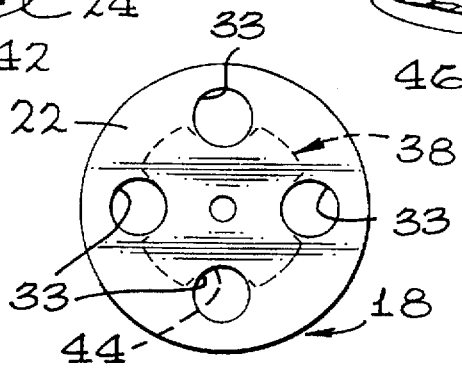
FIG. 3
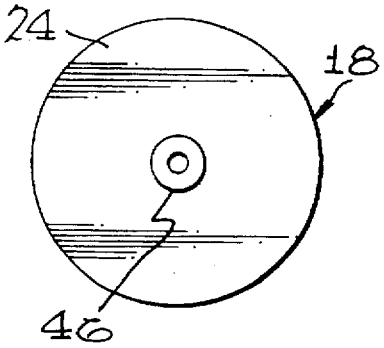
FIG. 4

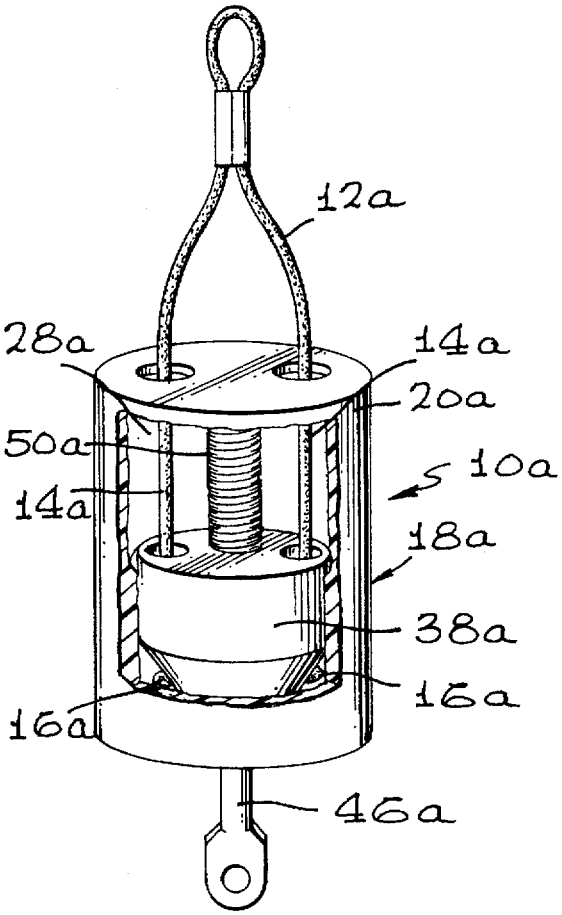
FIG. 6
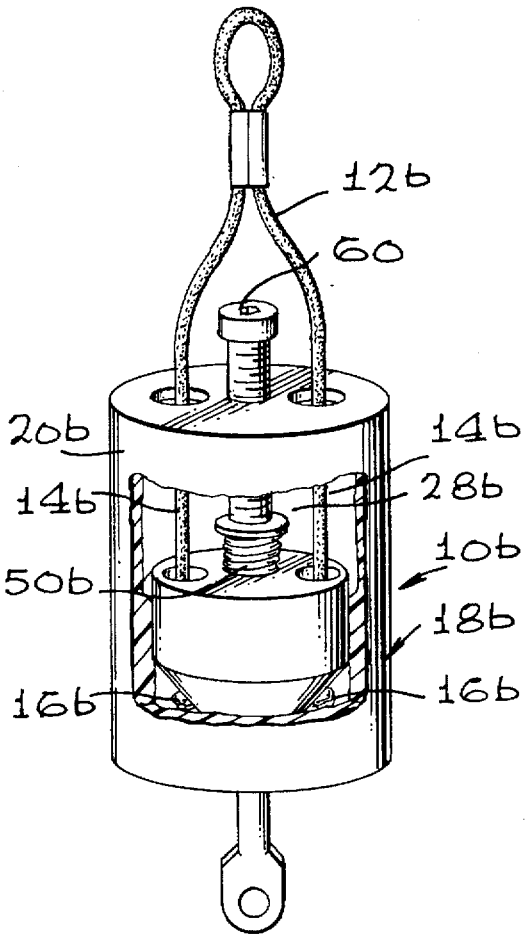
FIG. 7
FIG. 5
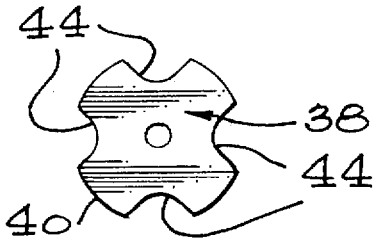

WINDOW COVERING CORD SAFETY ASSEMBLY

BACKGROUND OF THE INVENTION

1. Field of the Invention

The present invention generally relates to safety means and more particularly to an improved assembly which prevents children from becoming entangled in window covering control cords and strangling themselves.

2. Prior Art

The dangers of very young children becoming entangled in window covering control cords and strangling themselves is real, as evidenced by a SAFETY ALERT bulletin of the U.S. Consumer Product Safety Commission.

This problem has been addressed by various patents designed to reduce or eliminate such hazards. See, for example, U.S. Pat. No. 4,909,298 which discloses a cord device having two halves releasably connected together by Velcro-type strips, hooks, snaps or the like. Twisting forces on the halves, such as when a child becomes entangled in the cords and struggles to free himself or herself, causes them to release the ends of the entangling cords and free the child.

The same type of generally laterally separating action to free enclosed control cords is found in such U.S. Pats. Nos. as 5,504,977 5,494,092 and 5,473,797. Those patents disclose devices which, like U.S. Pat. No. 4,909,298 discussed above, are relatively complicated and which cannot be controlled within a given embodiment as to the force needed to cause the desired clam-shell separation to occur.

There remains a need for an improved window covering control cord protective means which is relatively simple, durable and inexpensive, which can be easily installed on one or more control cords and just as easily removed therefrom and which operates more efficiently than currently available devices and more in line with the direction of forces exerted when a child tries to free himself or herself from window cords.

The laterally twisting forces needed for the above-mentioned prior art devices are not those primarily and initially encountered when a child fights to free himself or herself from entangling cords.

Accordingly, there is a need for an improved cord safety device which employs for its operation the vertical forces primiarily and initially encountered during an entanglement episode. Such device should exhibit a faster reaction time and means to adjust the device to various degrees of force in order to operate.

SUMMARY OF THE PRESENT INVENTION

The improved window covering control cord safety assembly of the present invention satisfies all the foregoing needs. The assembly is substantially as set forth in the ABSTRACT OF THE DISCLOSURE. The assembly is simple, inexpensive, durable and efficient. It is also reuseable, being easily assembled and disassembled.

Thus, the assembly includes one or more window covering control cords, the lower free ends of which bear expanded portions such as eyelets or beads. The assembly also includes a safety device which has a housing with closed top and bottom and sides defining a generally central space within which is slideably disposed a retainer. Preferably, the housing and the upper portion of the retainer are generally cylindrical. The lower ends of the control cords and the eyelets pass down through the top of the housing and engage the retainer slideably disposed in the space.

The upper portion of the central space is expanded, relative to the lower portion of the central space, due to the presence of a stepped intermediate portion. The bottom portion of the retainer is generally inverted conical with spaced external pockets for releasably retaining the control cord lower ends and eyelets. The space and retainer are dimensioned to trap the control cord lower ends and eyelets in the pockets when the retainer is biased down toward the bottom of the housing by a spring disposed between the top of the retainer and the housing top in the space.

In a preferred embodiment a screw passes down through the housing top to adjustably compress the spring and thus control the degree of vertical force needed to allow the retainer to move up in the housing to a location where the lower portion of the retainer is in the upper expanded portion of the space and thus the cord ends and eyelets are freed from the pockets, causing the desired separation of housing and cords and freeing of a child tangled in the cords.

The device also includes an operating cord connected to the lower end of the retainer and extending below the housing, preferably in a tube. The tube, retainer and housing can be made of plastic, rubber, metal, ceramic or the like, as desired. The device is easy to install on one or more control cords and to remove therefrom, when desired.

Further features of the present invention are set forth in the following detailed description and accompanying drawings.

DRAWINGS

FIG. 1 is a schematic front perspective view, partly broken away of a first preferred embodiment of the improved assembly of the present invention, shown with the control cord ends and eyelets rapped in pockets in the retainer in the housing, the retainer being biased into the down position;

FIG. 2 is a schematic front perspective view, partly broken away, of the assembly of FIG. 1, shown with the retainer in the up position and with the control cord ends and eyelets freed from the retainer;

FIG. 3 is a reduced schematic top plan view of the housing of FIG. 1;

FIG. 4 is a reduced schematic bottom plan view of the housing of FIG. 1;

DETAILED DESCRIPTION

FIGS. 1–5

Figure 6:
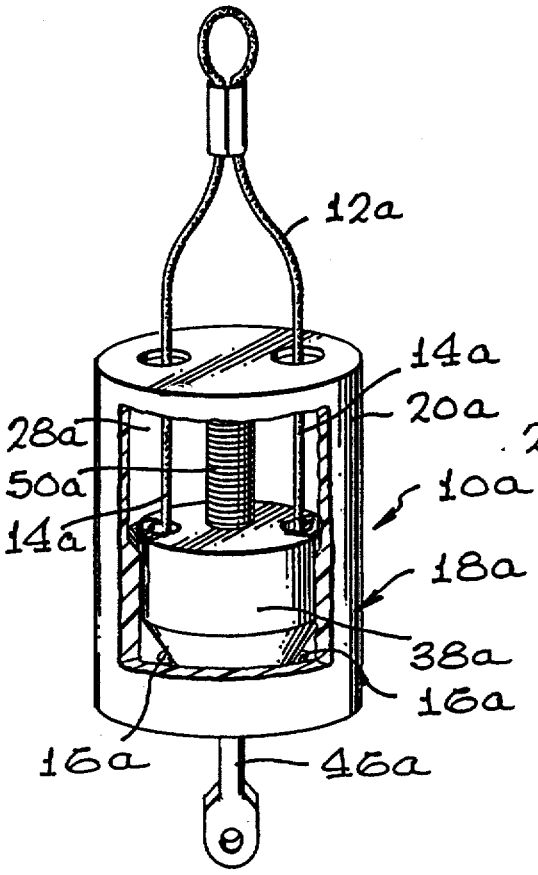
FIG. 6 is a schematic front perspective view, partly broken away, of a second preferred embodiment of the improved assembly of the present invention; and, FIG. 7 is a schematic front perspective view, partly broken away, of a third preferred embodiment of the improved assembly of the present invention.

Now referring more particularly to FIGS. 1–5 of the drawings, a first preferred embodiment of the improved window covering cord safety assembly of the present invention is schematically depicted therein.

Thus, assembly 10 is shown which comprises, in combination:

a) four flexible resilient window covering control cords 12 having free lower ends 14 bearing eyelets or expanded beads 16; and, b) a safety device 18 releasably connected ( as per FIG. 1) to the free lower ends 14 and eyelets 16. Safety device 18 comprises the following components, in combination:

1) A preferably generally cylindrical housing 20 is utilized and has a closed upper end 22, a closed opposite bottom end 24 and sidewalls 26 interconnecting top 22 and bottom 24 to define therewith a generally central internal space 28. The upper portion 30 of space 28 has a larger diameter, that is, is expanded relative to the lower portion 32 of space 28, an internal peripheral step 34 being present in the inner surface 36 of sidewalls 26, as shown in FIG. 1. Housing top 22 has a plurality of spaced openings 33 down through which cord ends 14 and eyelets 16 pass into central space 28.

Figure 5:
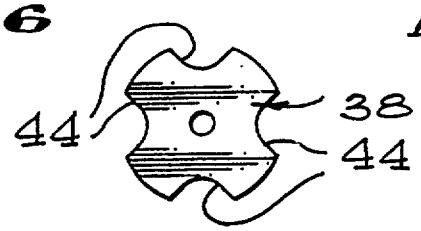
FIG. 5 is a reduced schematic top plan view of the retainer of FIG. 1.

2) A cord end retainer 38 is slideably disposed in space 28. Retainer 38 has an upper portion 40 dimensioned to about abut inner surfaces 34 of sidewalls 26 in lower portion 32 of space 28 and retainer 38 has a lower portion 42 which defines a plurality of spaced external pockets 44 releasably receiving and retaining cord lower ends 14 and eyelets 16. As can be seen in FIGS. 1,2 and 5, pockets 42 are vertical and extend from lower portion 42 up through upper portion 40 of retainer 38.

The lower portion 42 of retainer 38 decreases in diameter in a downwardly direction and may be, for example, generally inverted conical as shown in FIGS. 1 and 2. Therefore, when cord ends 14 and eyelets 16 are in pockets 44 they cannot be released therefrom until retainer 38 moves up in housing 20 from the locked position of FIG. 1 to the release position of FIG. 2.

In FIG. 1 it can be seen that upper portion 40 of retainer 38 blocks the removal of cord ends 14 and eyelets 16 from pockets 44 due to the close proximity of upper portion 40 to the adjacent internal surface 36 of sidewalls 26 in lower portion 32 of space 26. In FIG. 2 it can be seen that retainer 38 has moved up in housing 20 in the direction of the arrows to a position where upper portion 40 of retainer 38 is wholly in upper expanded portion 30 of central space 28 and lower portion 42 of retainer 38 is at least partially in portion 30 of space 28, thereby permitting cord ends 14 and eyelets 16 to pass out of pockets 44 and housing 20.

It will also be noted that the lower end of retainer 38 has a tubular extension 46 containing an assembly operating cord 48, which tube 46 and cord 48 extend through an opening (not shown) in bottom 24 of housing 20 and depend therefrom.

3) A coiled spring 50 is disposed vertically in space 28 between the upper end of retainer 38 and the undersurface of top 22. Spring 50 controls the extent of upward thrusting force needed to permit retainer 38 to move from the position of FIG. 1 to the position of FIG. 2, thus releasing cord ends 14 and eyelets 16 from housing 20. This vertical force is encountered when a child tries to free himself or herself from an entangling plurality of window covering control cords 12 and avoid strangulation. Accordingly, device 18 provides an improved degree of safety against such accidents. Device 18 is simple, inexpensive and effective, as is assembly 10.

FIG. 6

A second preferred embodiment of the improved safety assembly of the present invention is schematically depicted in FIG. 6. Thus, assembly 10a is shown. Components thereof which are similar to those of assembly 10 bear the same numerals but are succeeded by the letter "a".

Assembly **10*a* is substantially identical to assembly 10**, except as follows:

a) A single control cord **12*a* is depicted, formed into a loop, with the two lower ends 14*a* thereof terminating in beads 16*a*; and, b) Extension 46 which is integral with retainer 38** and depends therefrom is used as the operating cord.

Assembly **10*a* has the other advantages of assembly 10**.

FIG. 7

A third preferred embodiment of the improved assembly of the present invention is schematically depicted in FIG. 3. Thus, assembly **10*b* is shown. Components thereof similar to those of assembly 10 or 10*a*** bear the same numerals but are succeeded by the letter "b".

Assembly **10*b* is substantially identical to assembly 10*a***, except as follows:

Safety device **18*b* includes a screw 60 threaded down through top 22*b* of housing 20*b* into contact with the upper end of coiled spring 50*b*. Screw 60 is sufficiently long so that it can adjustably compress spring 50*b* and in so doing, it can control the degree of force needed to be exerted upwardly on retainer 38*b* to move retainer 38*b* from the lock position of FIG. 7 to the cord release position ( not shown) comparable to that shown in FIG. 2 for assembly 10. This adjustability affords an increased measure of safety and convenience and assures that cord ends 14*b* will not separate from housing 20*b*** under excessively light separating force.

The improved assembly depicted in FIGS. 1–7 in its various embodiments reduces the hazards associated with window covering cords. On an average throughout the nation each month a child dies from becoming entangled in window covering control cords. Most such accidents occur when the child is trapped in the closed loop characteristically formed by the control cord array.

When the improved assembly of the present invention is used, such dangers are materially reduced. The assembly allows one cord to operate the window covering and the closed loop above the device opens under a relatively low force of under a pound or so, a force easily generated by a child as he or she becomes entangled in the loop.

The device of the assembly can accommodate one or a plurality such as 4 separate operating cords, in contrast to many conventional cord safety devices. Moreover, the device releases the cords to open the closed loop whether or not the cords are crossed, twisted or tangled, also in contrast to other cord safety devices. See, for example, the devices of the patents referred to above, which devices cannot operate properly when the control cords are twisted together. Accordingly, the present assembly and safety device have significant advantages over conventional assemblies and devices.

Various modifications, changes, alterations and additions can be made in the assembly and device of the present invention and in the components and parameters thereof. All such modifications, changes, alterations and additions as are within the scope of the appended claims form part of the present invention.

What is claimed is:

1. An improved window covering cord safety assembly, said assembly comprising, in combination:

a) at least one window covering control cord having a free end bearing an expanded eyelet; and, b) a safety device connected to said free end of said control cord and adapted to release said cord end at a predetermined pull pressure on said cord, said safety device comprising, in combination:

1) a housing having a closed upper end, a closed opposite bottom end and sidewalls interconnecting said upper end and said lower end to define a generally central space, said sidewalls having upper and lower portions, the distance between the inner surfaces of said upper portion of said sidewalls being greater than the distance between the inner surfaces of the lower portion of said sidewalls, whereby the upper portion of said space is expanded relative to the lower portion of said space, said housing including an opening in said housing upper end down through which said control cord and eyelet pass, 2) a retainer slideably received in said space for movement between said lower and upper portions of said space, said retainer having a lower portion defining an external pocket trapping said control cord and eyelet when said retainer is in said lower portion of said space but releasing said eyelet to free said control cord when said retainer pocket is in said upper portion of said space 3) an operating cord connected to said retainer and extending downwardly through an opening in said housing bottom, and, 4) a spring positioned in said housing space between the upper end of said retainer and the upper end of said housing and biasing said retainer in said housing, said spring controlling the upward pressure needed to be exerted on said control cord in order to move said retainer to said upper expanded portion of said space to release said control cord from said housing.

2. The improved assembly of claim 1 wherein said assembly includes a plurality of said control cords spaced from each other and with end eyelets and wherein said control cords and eyelets pass down into said housing and are trapped in separate pockets in the lower portion of said retainer until said lower portion of said retainer is moved against said spring bias to said upper portion of said space.

3. The improved assembly of claim 1 wherein said operating cord is connected directly to said retainer and wherein said spring is a coiled spring secured to the top of said retainer and the inner surface of the top of said housing.

4. The improved asembly of claim 1 wherein the upper portion of said retainer is generally cyclindrical and the lower portion of said retainer is generally inverted conical with a central depending rod containing said operating cord, and wherein said housing is generally cylindrical with a step between said lower and upper portions of the inner surfaces of said housing.

5. The improved assembly of claim 1 wherein said operating cord is a stiff rod integral with said retainer and wherein said eyelets are beads.

6. The improved assembly of claim 5 wherein said assembly has a pair of said control cords which form a closed connector loop with two leads above said housing, said two leads forming said lower ends of said control cords.

7. The improved assembly of claim 1 wherein said device includes an adjustable screw threaded down through said housing top into contact with the top of said spring, whereby the compression on said spring is adjustable to control the force necessary to move said retainer upwardly to said upper portion of said space and release said control cord from said housing.

8. The improved assembly of claim 1 wherein said housing and said retainer comprise plastic.

* * * * *

UNITED STATES PATENT AND TRADEMARK OFFICE

CERTIFICATE OF CORRECTION

PATENT NO. : 5,715,884
DATED : February 10, 1998
INVENTOR(S) : Fred Cotten

Figure 7:
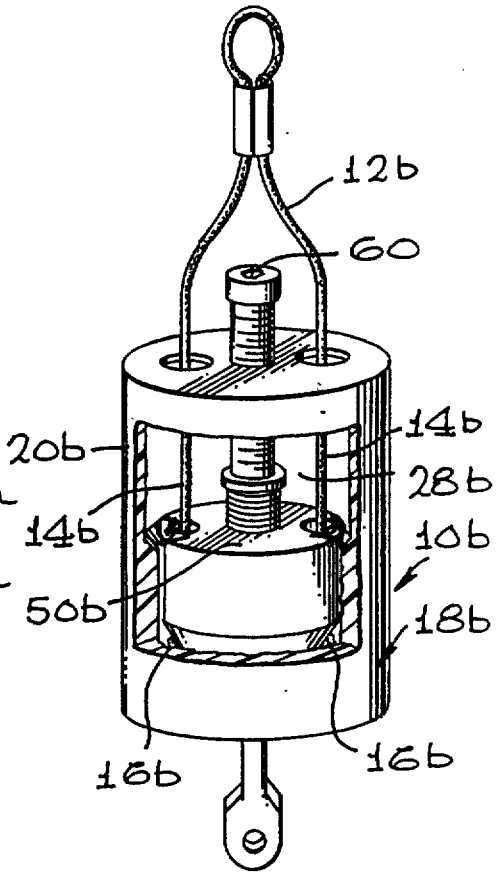

It is certified that error appears in the above-identified patent and that said Letters Patent is hereby corrected as shown below:

The sheets of drawings, consisting of figures 5, 6, and 7, should be deleted to appear as per attached figures.

Signed and Sealed this

Fourth Day of April, 2000

*Attest:*

Q. TODD DICKINSON

*Attesting Officer*

*Director of Patents and Trademarks*